US005254155A

United States Patent [19]

Mensi

[11] Patent Number: 5,254,155

[45] Date of Patent: Oct. 19, 1993

[54] WET ELECTROSTATIC IONIZING ELEMENT AND COOPERATING HONEYCOMB PASSAGE WAYS

[76] Inventor: Fred E. Mensi, 101 Peach St., Avenel, N.J. 07001

[21] Appl. No.: 874,391

[22] Filed: Apr. 27, 1992

[51] Int. Cl.[5] ..... B03C 3/41; B03C 3/78

[52] U.S. Cl. ..... 96/44; 96/53; 96/62; 96/65; 96/97; 96/100

[58] Field of Search ..... 55/152, 150, 7, 13, 55/118-120, 122, 129, 130, 156; 323/903; 361/226, 230

[56] References Cited

U.S. PATENT DOCUMENTS

| | | | |
|---|---|---|---|
| 3,483,671 | 12/1969 | Wiemer | 55/152 X |
| 3,555,818 | 1/1971 | Vlier | 55/152 X |
| 3,716,966 | 2/1973 | De Seversky | 55/118 |
| 3,979,193 | 9/1976 | Sikich | 55/152 X |
| 4,194,888 | 3/1980 | Schwab et al. | 55/152 X |
| 4,308,038 | 12/1981 | Michel | 55/118 |
| 4,441,897 | 4/1984 | Young et al. | 55/118 X |
| 4,848,986 | 7/1989 | Leluschko et al. | 55/152 |

FOREIGN PATENT DOCUMENTS

| | | | |
|---|---|---|---|
| 507914 | 9/1930 | Fed. Rep. of Germany | 55/152 |
| 855621 | 12/1960 | United Kingdom | 55/152 |

*Primary Examiner*—Richard L. Chiesa
*Attorney, Agent, or Firm*—Richard L. Miller

[57] ABSTRACT

A wet electrostatic precipitator device is provided which has a plurality of hexagonal honeycomb collector passage ways, a corresponding mating plurality of stationary rod elements to be centrally located at axes of each said hexagonal honeycomb collector passage ways and a set of bands integrally formed with a multiplicity of the ionizing blades which protrude from the surfaces of each of the stationary rod elements. The geometry of the design has a high degree of efficiency, while at the same time causes the ionizing blades to maintain their electrostatic charging characteristics under a harsh set of environmental conditions.

3 Claims, 2 Drawing Sheets

FIG. 1
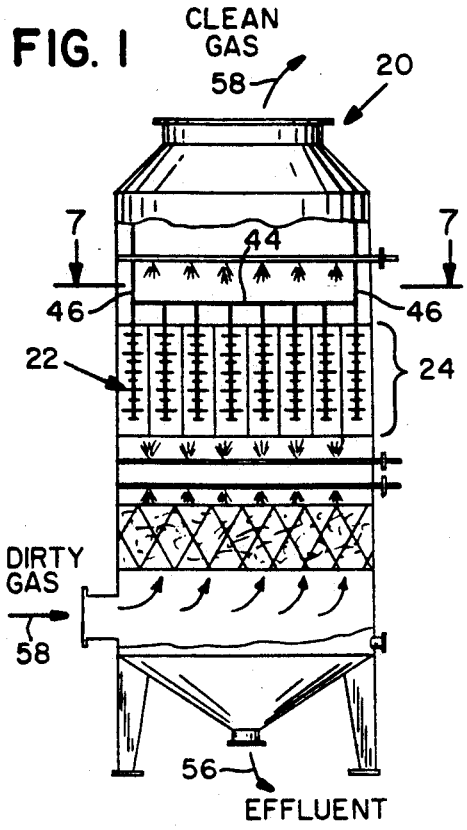
FIG. 2
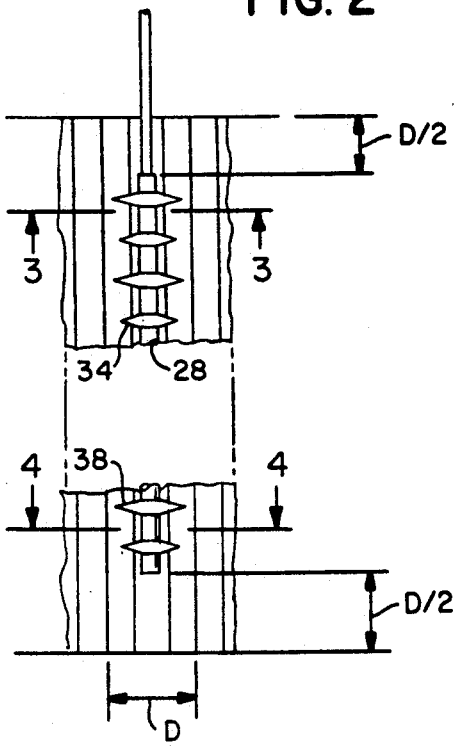
FIG. 4
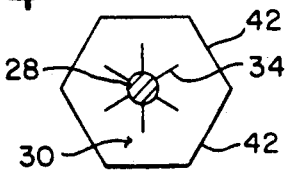
FIG. 3
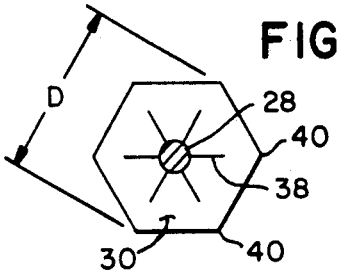
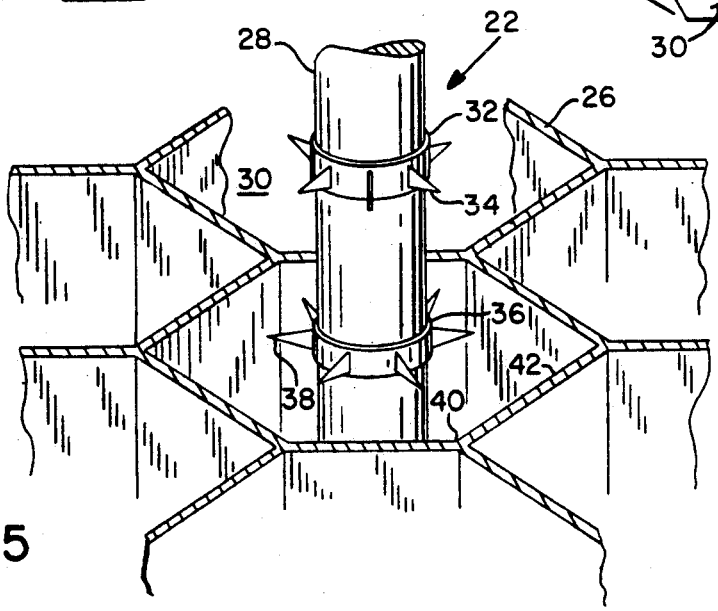
FIG. 5

FIG. 6
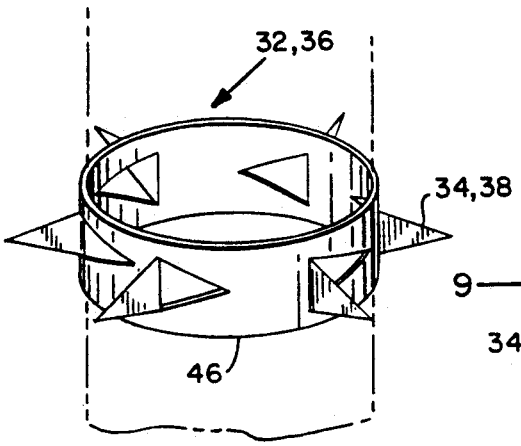
FIG. 8
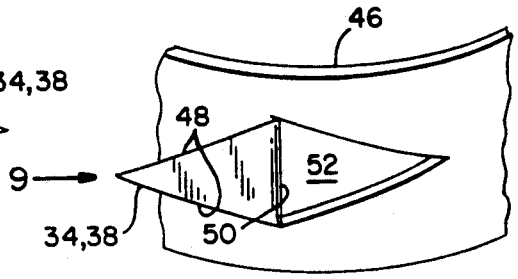
FIG. 7
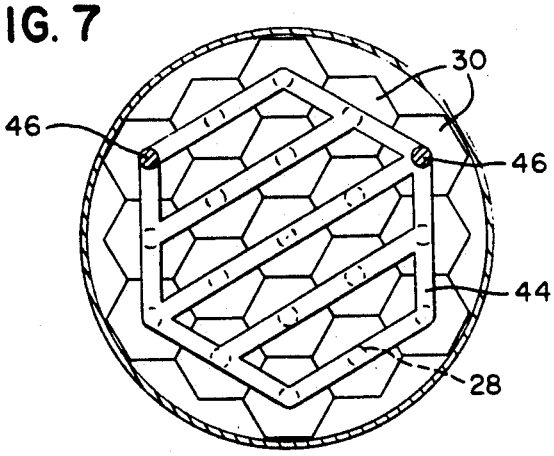
FIG. 9
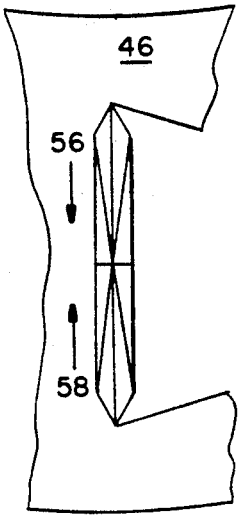
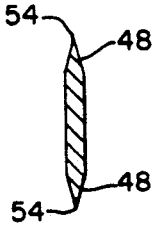
FIG. 11
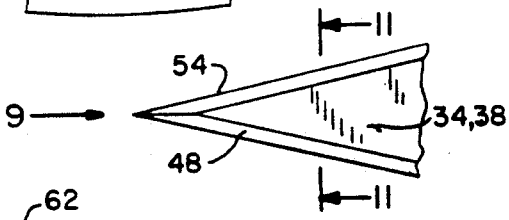
FIG. 10
FIG. 12
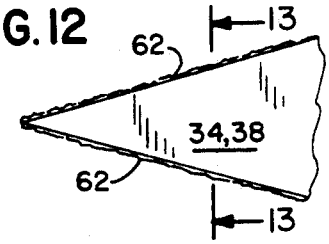
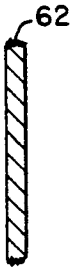
FIG. 13
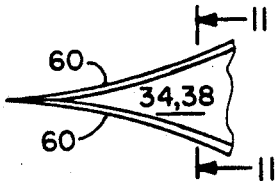
FIG. 14

WET ELECTROSTATIC IONIZING ELEMENT AND COOPERATING HONEYCOMB PASSAGE WAYS

BACKGROUND OF THE INVENTION

Field of the Invention

The instant invention relates generally to wet electrostatic precipitator devices and more specifically to the exact design of the electrostatic elements and the spacial relationship between the electrostatic ionizing elements and the cooperating honeycomb collector passage ways.

A wet electrostatic precipitator is an apparatus which separates suspended particles of solid or liquid material from a gas stream. It is widely used in air pollution control technology, chemical and metallurgical industries.

The separation process consists of the following steps:

1. Electrical charging of suspended particles is accomplished by negative ions produced by so called corona discharge which in effect is a current flow through an air gap between a positive (usually grounded) electrode and a negative ionizing electrode. These electrodes are connected to a source of high voltage direct current HVDC. The value of HVDC depends on the distance between the electrodes and the properties of the gas stream to be processed. For industrial equipment where the gases can be very contaminated with coarse and sticky particles, a relatively large gap distance and high voltages are essential for long lasting and reliable operation and usually are respectively in the range of 4" to 6" and 30,000 to 75,000 volts;

2. Collection of the charged particles on the surface of positive collecting electrodes. Electrostatic attraction forces between negative particles and the positive collector are caused to create a so called "migration velocity" perpendicular to the direction of the gas flow. This velocity causes the particles to strike the surface of the collecting electrodes. At this point the particles give way to negative charge on the "grounded" collector and charges from all particles in the form of returning current flow arrive back to the high voltage transformer to complete the electrical circuit; and 3. Removal of collected particles from the collecting electrodes surface. In the wet electrostatic precipitator, this is accomplished by washing away the collected particles continuously using collected liquid mist from the gas stream. This liquid mist is introduced into the gas flow for cooling and rescrubbing action before the collecting section of the wet electrostatic precipitator device and after the wet electrostatic precipitator device, solely for cleaning contaminates from the collecting electrodes.

The three steps described above are generally utilized in the vertical tubular design of wet electrostatic precipitator systems, where the collecting electrodes are in the shape of tubes and the ionizing electrodes are in the shape of round cylindrical rods located at the center of each respective tube.

Description of the Prior Art

Numerous wet electrostatic precipitator devices have been provided in the prior art that are adapted to separate suspended particles of solid or liquid material from a gaseous steam. For example, U.S Pat. Nos. 3,716,966 to De Seversky; 4,308,038 to Michel and 4,441,897 to Young et al all are illustrative of such prior art. While these units may be suitable for the particular purpose to which they address, they would not be as suitable for the purpose of the present invention as hereafter described.

SUMMARY OF THE INVENTION

A primary object of the present invention is to provide a wet electrostatic ionizing element and cooperating honeycomb passage ways that will overcome the shortcomings of the prior art devices.

Another object is to provide a wet electrostatic ionizing element and cooperating honeycomb passage ways in which the electrostatic ionizing elements are self sharpening and therefore tend to be self maintaining when acted upon by the abrasive and corrosive properties of particle suspended in a gaseous fluid mixture.

An additional object is to provide a wet electrostatic ionizing element and cooperating honeycomb passage ways which has a high degree of efficiency, that is one in which nearly all of the cross sectional face area of the instant invention is utilized.

A further object is to provide a wet electrostatic ionizing element and cooperating honeycomb passage ways that is simple and easy to use.

A still further object is to provide a wet electrostatic ionizing element and cooperating honeycomb passage ways that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic view of a wet electrostatic precipitator with parts broken away showing the instant invention installed therein;

FIG. 2 is an enlarged diagrammatic view of a single honeycomb passageway and element;

FIG. 3 is a still further enlarged diagrammatic cross sectional view taken on line 3—3 of FIG. 2;

FIG. 4 is another cross sectional view similar to FIG. 3 taken on line 4—4 of FIG. 2;

FIG. 5 is an enlarged diagrammatic perspective view partly in section, with parts broken away illustrating the spacial relationship between a typical ionizing element and a cooperating collector honeycomb passage way;

FIG. 6 is a still further enlarged diagrammatic perspective view of a set of ionizing precipitator blades;

FIG. 7 is a diagrammatic cross sectional view taken on line 7—7 of FIG. 1;

FIG. 8 is a still further enlarged diagrammatic perspective view of just a single ionizing precipitator blade;

FIG. 9 is a still further enlarged diagrammatic end view taken in the direction of arrow 9 in FIGS. 8 and 11;

FIG. 10 is a diagrammatic view illustrating in further detail the construction of a first embodiment of a typical blade;

FIG. 11 is a cross sectional view taken on line 11—11 of FIGS. 10 and 14;

FIG. 12 is a view similar to FIG. 10 illustrating the construction of a second embodiment of a typical blade;

FIG. 13 is a cross sectional view taken on line 13—13 of FIG. 12; and

FIG. 14 is a view also similar to FIG. 10 illustrating the construction of a third embodiment of a typical blade.

DETAILED DESCRIPTION OF THE PREFERRED EMBODIMENTS

Turning now descriptively to the drawings, in which like reference characters denote like elements throughout the several views, FIG. 1 shows a typical complete wet electrostatic precipitator system 20 of which the instant invention, that is the ionizing element(s) and the cooperating collector honeycomb passage ways 22, are installed therein and occupies the space 24 and is the subject of the description which follows.

FIG. 5 shows a typical piece of the cooperating collector honeycomb passage ways 26 broken away, with a stationary rod element 28 also broken away, mounted centrally in a single hexagonal passage way 30 supporting a first crown 32 having short spine 34 extending therefrom and a second crown 36 having long spine 38 extending therefrom. It is to be noted that every other crown is to be alternately followed by a short and a long set of spines best illustrated by FIG. 2.

The stationary rod elements 28 are typically secured to a hexagonal configuration of bars 44 which is appropriately mounted in the system 20 by securement members 46, as best seen in FIGS. 1 and 7.

Although there is a large variation of dimension which can be chosen depending on a variety of operating parameters for which the device is being designed, a typical working example might be as follows:

EXAMPLE

The diameter of rod 28 equal one inch, distance across flats of hexagonal passage way 30 equal to six inches, length of short spines 34 equal to $\frac{1}{4}$ of an inch, and length of long spines 38 equal to $\frac{3}{8}$ of an inch.

As seen in FIG. 3 and 4 respectively, the long spines 38 are positioned to point at the apexes 40 of the passage way 30, while the short spines 34 are positioned to point at the mid points 42 of the flat sides of the passage ways 30.

Another parameter which is important in the design of the instant invention, in order that there not be any inadvertent electrical discharging between the stationary rods 28 and the hexagonal passage ways 30, is the distance which should be kept free of any spines at the entrance and exit, for fluids respectively entering and leaving the hexagonal passage ways 30, which should be at least D/2, where D is the distance from opposite apexes 40 of a hexagonal passage way 30, as best illustrated in FIG. 2.

As best seen in FIGS. 6 and 8, the crowns 32, 36 can be fabricated by punching a substantially triangular spine 34, 38 out of an appropriate band 46 of suitable metal, having two isosceles edges 48, and folded out in a radial direction at base edge 50, leaving a substantially triangular wedge shaped opening 52 in band 46. The band can be either force fitted or tack welded to the rod 28 as a matter of design choice.

The efficiency of the spines can be enhanced if the edges 48 are sharpened to a knife edge 54 as illustrated by FIGS. 9, 10 and 11. The directions of effluent and gaseous flows respectively illustrated by arrows 56 and 58, set up an abrasive sharpening condition causing the spines to be continuously sharpened by the movements of both materials through the ionizing element 22.

In a second embodiment, if the spine has typically a chemically roughen edge 62 as illustrated in FIGS. 12 and 13, the ionization characteristics are improved, however this property does not tend to be maintained by the movements of both materials through the ionizing element 22.

In a third embodiment, if the spine is shaped with concave knife sharp edges 60, as illustrated in FIGS. 11 and 14 the spine seems to better maintain its desired electrostatic charging characteristics as it wears under the abrasive influences of the fluids which erode it away.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A wet electrostatic precipitator device which comprises:

a) a plurality of hexagonal honeycomb collector passage ways;

b) a corresponding mating plurality of stationary rod elements to be centrally located at axes of each said hexagonal honeycomb collector passage way; and c) means for securing a multiplicity of ionizing blades to a surface of each said stationary rod elements wherein said means is a band fitted over said stationary rod and fabricated by punching out and folding back in a radial direction a group of six substantially triangular spines to form several sets of a first crown and several sets of a second crown, wherein each of said spines of said first crowns are positioned to point at an apex of said hexagonal honeycomb collector passage way, each of said spines of said second crowns are positioned to point at a mid point of a flat side of said hexagonal honeycomb collector passage way, and each of said spines of said second crowns are shorter than said spines of said first crowns.

2. A wet electrostatic precipitator device as recited in claim 1, wherein each of said spines has a straight edge which is sharpened to a knife edge.

3. A wet electrostatic precipitator device as recited in claim 1, wherein each of said spines has a concave edge which is sharpened to a knife edge.

* * * * *